US012304762B2

(12) United States Patent
Edo et al.

(10) Patent No.: US 12,304,762 B2
(45) Date of Patent: May 20, 2025

(54) SHEET FEEDER, IMAGE FORMING APPARATUS, SHEET FEEDING METHOD, AND STORAGE MEDIUM

(71) Applicants: Yohsuke Edo, Kanagawa (JP); Tatsuya Sugawara, Kanagawa (JP); Yohsuke Takamiya, Kanagawa (JP); Hidetoshi Kojima, Kanagawa (JP)

(72) Inventors: Yohsuke Edo, Kanagawa (JP); Tatsuya Sugawara, Kanagawa (JP); Yohsuke Takamiya, Kanagawa (JP); Hidetoshi Kojima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 186 days.

(21) Appl. No.: 18/221,828

(22) Filed: Jul. 13, 2023

(65) Prior Publication Data

US 2024/0034578 A1 Feb. 1, 2024

(30) Foreign Application Priority Data

Jul. 26, 2022 (JP) ..... 2022-119103

(51) Int. Cl.

| | |
|---|---|
| ***B65H 3/48*** | (2006.01) |
| ***B65H 1/14*** | (2006.01) |
| ***B65H 3/08*** | (2006.01) |

(52) U.S. Cl.

CPC ..... *B65H 3/08* (2013.01); *B65H 1/14* (2013.01); *B65H 3/48* (2013.01); *B65H 2511/20* (2013.01); *B65H 2801/06* (2013.01)

(58) Field of Classification Search

CPC ... B65H 1/18; B65H 3/08; B65H 3/48; B65H 3/60

See application file for complete search history.

(56) References Cited

U.S. PATENT DOCUMENTS

| | | | | |
|---|---|---|---|---|
| 4,801,135 A * | 1/1989 | Povio | ..... | B65H 1/18 271/157 |
| 5,794,928 A * | 8/1998 | Araseki | ..... | B65H 1/14 271/157 |
| 7,267,335 B2 * | 9/2007 | Kubo | ..... | B65H 1/14 271/127 |

(Continued)

FOREIGN PATENT DOCUMENTS

| | | | |
|---|---|---|---|
| JP | 2004083206 A * | 3/2004 | |
| JP | 2011-157207 | 8/2011 | |

(Continued)

*Primary Examiner* — Howard J Sanders

(74) *Attorney, Agent, or Firm* — Duft & Bornsen, PC

(57) ABSTRACT

A sheet feeder includes a sheet loading tray, an air blower, a side air blower, and processing circuitry. The sheet loading tray loads sheets. The air blower blows air to the sheets to float and separate the sheets. The side air blower blows air to the sheets to separate the sheets. The processing circuitry controls a tray elevator to rise the sheet loading tray to move the sheets to an upper limit position, after a predetermined time has elapsed from a time when the sheets are loaded on the sheet loading tray. The processing circuitry causes the air blower and the side air blower to blow air to the sheets to perform sheet separation and controls the tray elevator to lower the sheet loading tray to a position at which an intermediate remaining-sheet sensor is disposed, after the sheet separation ends.

7 Claims, 10 Drawing Sheets

(56) References Cited

U.S. PATENT DOCUMENTS

| | | | | |
|---|---|---|---|---|
| 7,604,232 | B2 * | 10/2009 | Nakashima | B65H 1/26 271/164 |
| 10,065,817 | B2 * | 9/2018 | Kurohata | B65H 1/14 |
| 10,167,147 | B2 * | 1/2019 | Yamauchi | B65H 1/14 |
| 11,597,616 | B2 * | 3/2023 | Fukasawa | B65H 7/14 |
| 11,629,019 | B2 * | 4/2023 | Morita | B65H 3/128 271/98 |
| 12,091,269 | B2 * | 9/2024 | Takamiya | B65H 7/20 |
| 2011/0187044 | A1 | 8/2011 | Utagawa et al. | |
| 2014/0131938 | A1 | 5/2014 | Satoh et al. | |
| 2017/0174453 | A1 | 6/2017 | Akai et al. | |
| 2017/0174454 | A1 | 6/2017 | Matsuoka et al. | |
| 2017/0174458 | A1 | 6/2017 | Takano et al. | |
| 2017/0174462 | A1 | 6/2017 | Edo et al. | |
| 2018/0141769 | A1 | 5/2018 | Edo | |
| 2019/0210821 | A1 | 7/2019 | Edo et al. | |

FOREIGN PATENT DOCUMENTS

| | | |
|---|---|---|
| JP | 2011-225289 | 11/2011 |
| JP | 2021-100869 | 7/2021 |

* cited by examiner

| FIG. 9A |
| --- |
| FIG. 9B |

SHEET FEEDER, IMAGE FORMING APPARATUS, SHEET FEEDING METHOD, AND STORAGE MEDIUM

CROSS-REFERENCE TO RELATED APPLICATION

This patent application is based on and claims priority pursuant to 35 U.S.C. § 119(a) to Japanese Patent Application No. 2022-119103, filed on Jul. 26, 2022, in the Japan Patent Office, the entire disclosure of which is hereby incorporated by reference herein.

BACKGROUND

Technical Field

Embodiments of the present disclosure relate to a sheet feeder, an image forming apparatus, a sheet feeding method, and a storage medium.

Related Art

Sheet feeders may not peel off sheets stuck together unless sheet separation is performed in advance before sheets are loaded on a sheet feeding tray (serving as a sheet loading tray). In the market, a vibration- or air-type sheet separating device is purchased, sheet separation is performed in advance by the sheet separating device once, and sheets are loaded onto the sheet feeding tray after the sheet separation is completed.

SUMMARY

Embodiments of the present disclosure described herein provide a novel sheet feeder including a sheet loading tray, an air blower, a side air blower, and processing circuitry. The sheet loading tray loads sheets. The air blower is disposed to face a leading end of the sheets loaded on the sheet loading tray in a feeding direction of the sheets. The air blower to blow air to the sheets to float and separate the sheets. The side air blower is disposed to face an end of the sheets in a direction orthogonal to the feeding direction of the sheets. The side air blower to blow air to the sheets to separate the sheets. The processing circuitry controls a tray elevator to rise the sheet loading tray to move the sheets to an upper limit position, after a predetermined time has elapsed from a time when the sheets are loaded on the sheet loading tray being pulled out from a housing of an image forming apparatus. The processing circuitry causes the air blower and the side air blower to blow air to the sheets to perform sheet separation when the sheets on the sheet loading tray are moved to the upper limit position. The processing circuitry controls the tray elevator to lower the sheet loading tray to a position at which an intermediate remaining-sheet sensor is disposed between the upper limit position and a lower limit position of the sheet loading tray, after the sheet separation ends.

Embodiments of the present disclosure described herein provide a novel sheet feeding method executed by a sheet feeder. The method includes: lifting a sheet loading tray, which loads sheets, to move the sheets to an upper limit position, after a predetermined time has elapsed from a time when the sheets are loaded on the sheet loading tray being pulled out from a housing of an image forming apparatus; blowing air by an air blower and a side air blower, to perform sheet separation when the sheets on the sheet tray are moved to the upper limit position, the air blower being disposed to face a leading end of the sheets in a feeding direction of the sheets loaded on the sheet loading tray and to blow air to the sheets to float and separate the sheets, and the side air blower being disposed to face an end of the sheets in a direction orthogonal to the feeding direction of the sheets and to blow air to the sheets to separate the sheets; and lowering the sheet loading tray to a position at which an intermediate remaining-sheet sensor is disposed between the upper limit position and a lower limit position of the sheet loading tray, after the sheet separation ends.

Embodiments of the present disclosure described herein provide a novel non-transitory, computer-readable storage medium storing computer-readable program code that causes a computer to perform: controlling a tray elevator to lift a sheet loading tray, which loads sheets, to move the sheets to an upper limit position, after a predetermined time has elapsed from a time when the sheets are loaded on the sheet loading tray being pulled out from a housing of an image forming apparatus; controlling an air blower and a side air blower to blow air to perform sheet separation when the sheets on the sheet tray are moved to the upper limit position, the air blower being disposed to face a leading end of the sheets in a feeding direction of the sheets loaded on the sheet loading tray and blow air to the sheets to float and separate the sheets, and the side air blower being disposed to face an end of the sheets in a direction orthogonal to the feeding direction of the sheets and blow air to the sheets to separate the sheets; and controlling the tray elevator to lower the sheet loading tray to a position at which an intermediate remaining-sheet sensor is disposed between the upper limit position and a lower limit position of the sheet loading tray, after the sheet separation ends.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
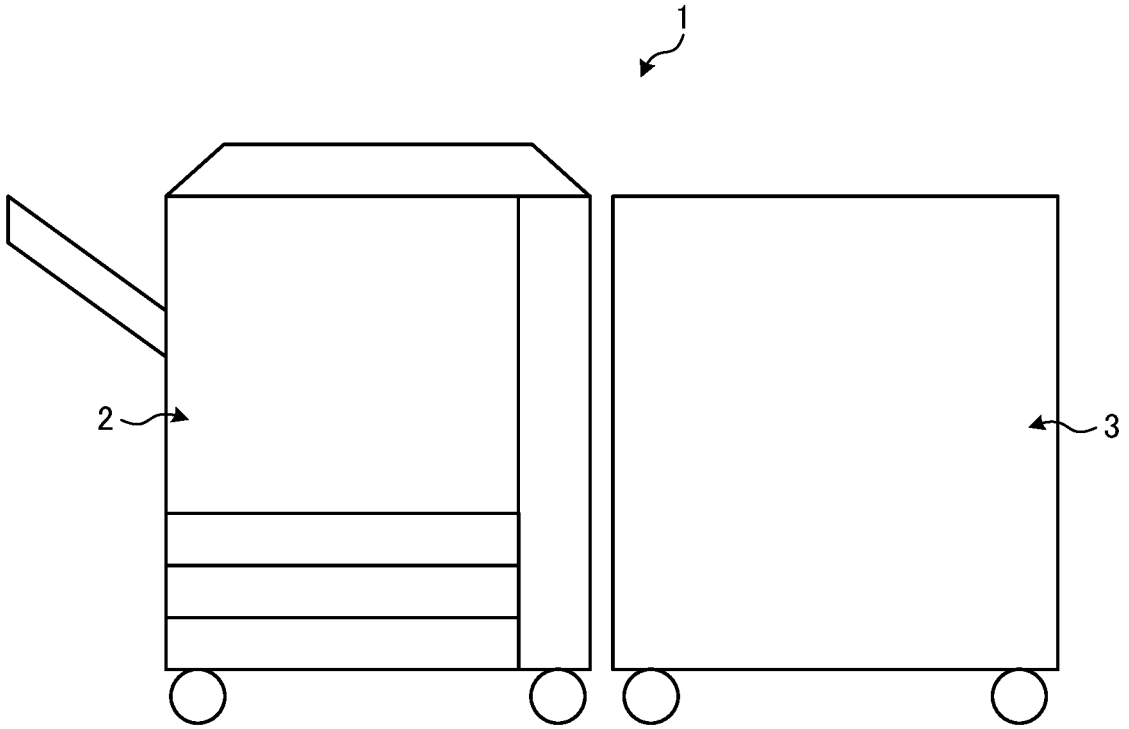
FIG. 1 is a diagram illustrating an image forming apparatus including a sheet feeder according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

A description is given below in detail of a sheet feeder, an image forming apparatus, a sheet feeding method, and a storage medium according to an embodiment of the present disclosure with reference to the drawings.

FIG. 1 is a diagram illustrating the image forming apparatus including a sheet feeder according to an embodiment of the present disclosure. As illustrated in FIG. 1, an image forming apparatus 1 includes an image forming device 2 as an image forming device and a sheet feeding device 3.

The image forming device 2 forms an image on a sheet (a recording medium such as a sheet of paper) that is supplied, by a known method such as an electrophotographic process or an inkjet process. Since a detailed configuration of the image forming device 2 is not an essential part, a description thereof is omitted.

The sheet feeding device 3 includes a sheet feeder 10 (see FIG. 4) that serves as a sheet feeder. The sheet feeder 10 feeds a sheet to the image forming device 2 via a conveyance passage.

Figure 2:
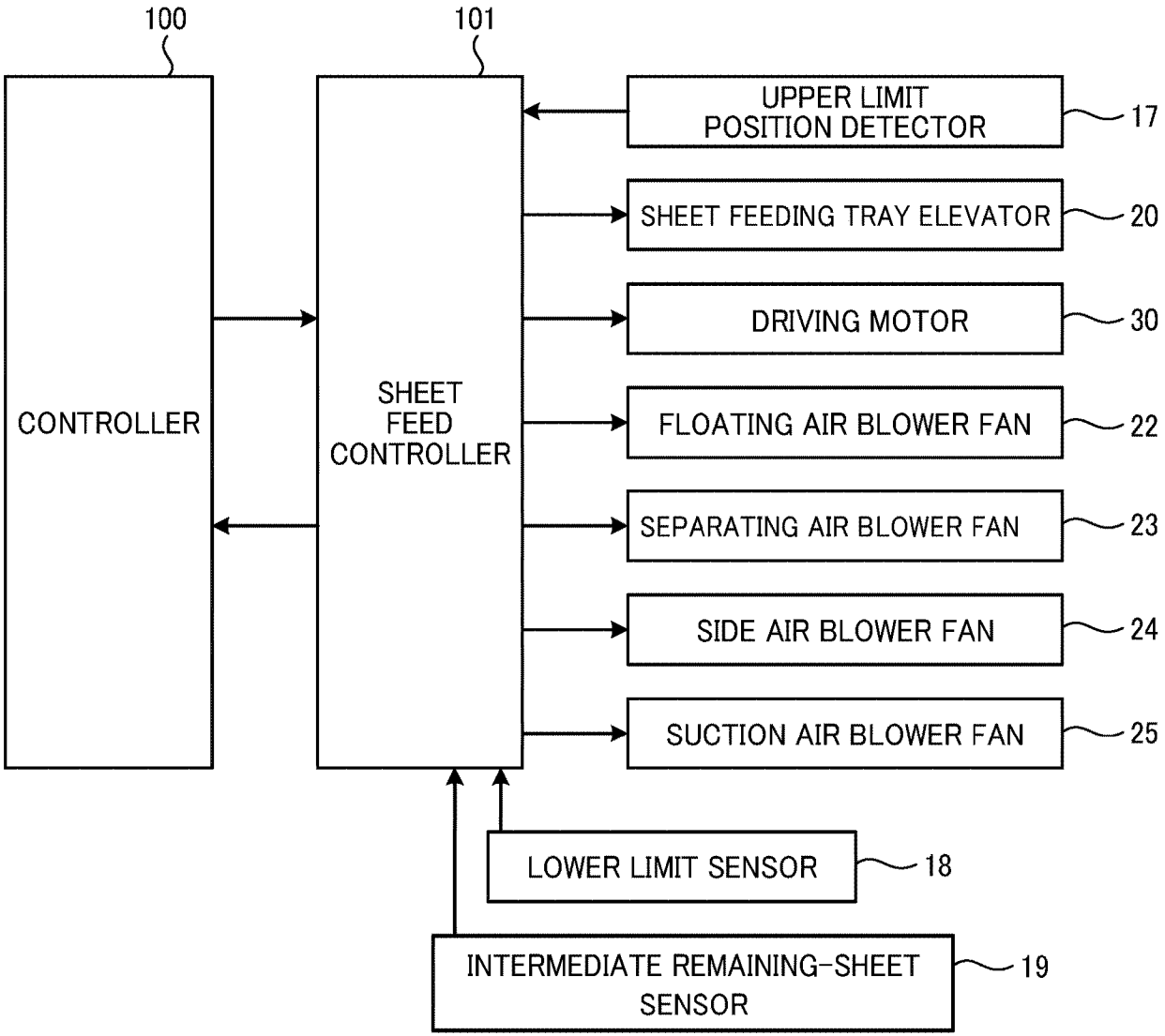
FIG. 2 is a block diagram illustrating a hardware configuration of the image forming apparatus according to an embodiment of the present disclosure.
Figure 3:
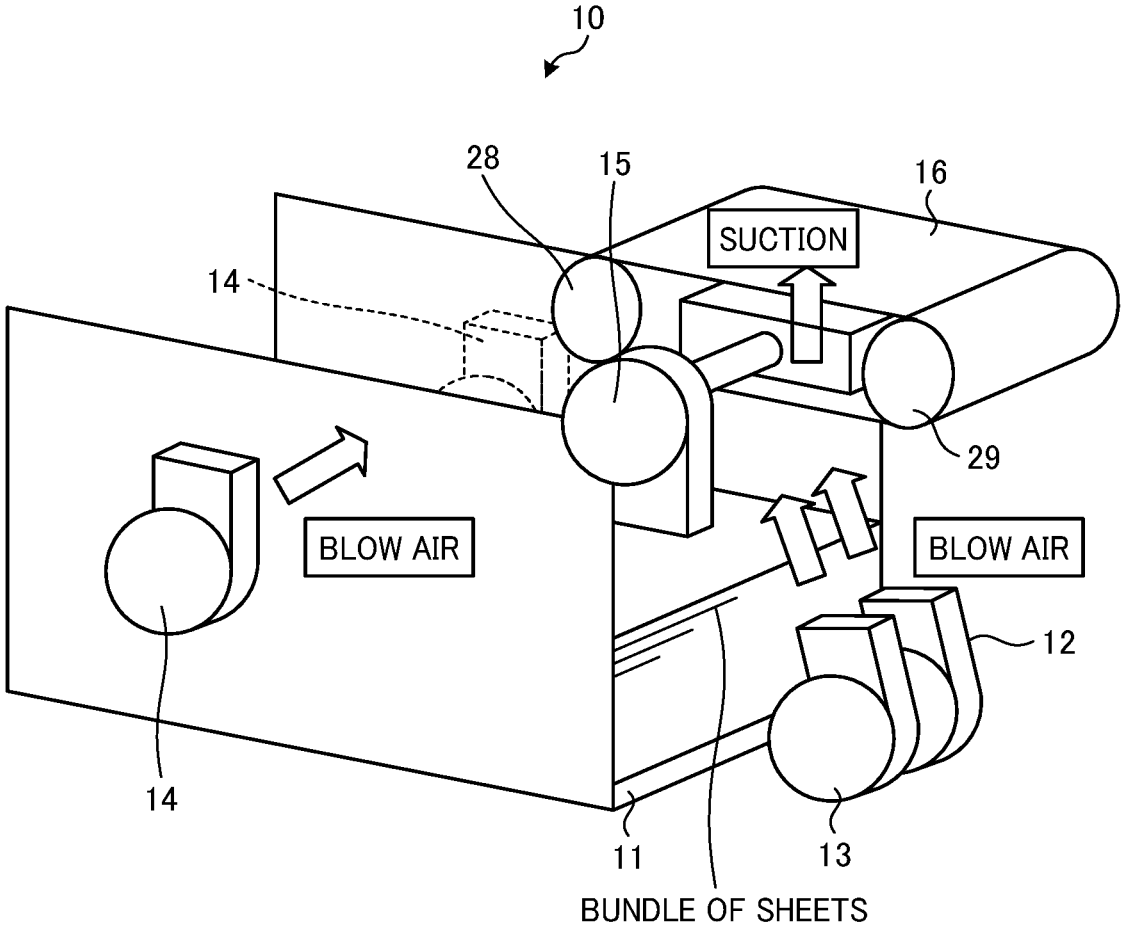
FIG. 3 is a perspective view of a configuration of the sheet feeder according to an embodiment of the present disclosure.
Figure 4:
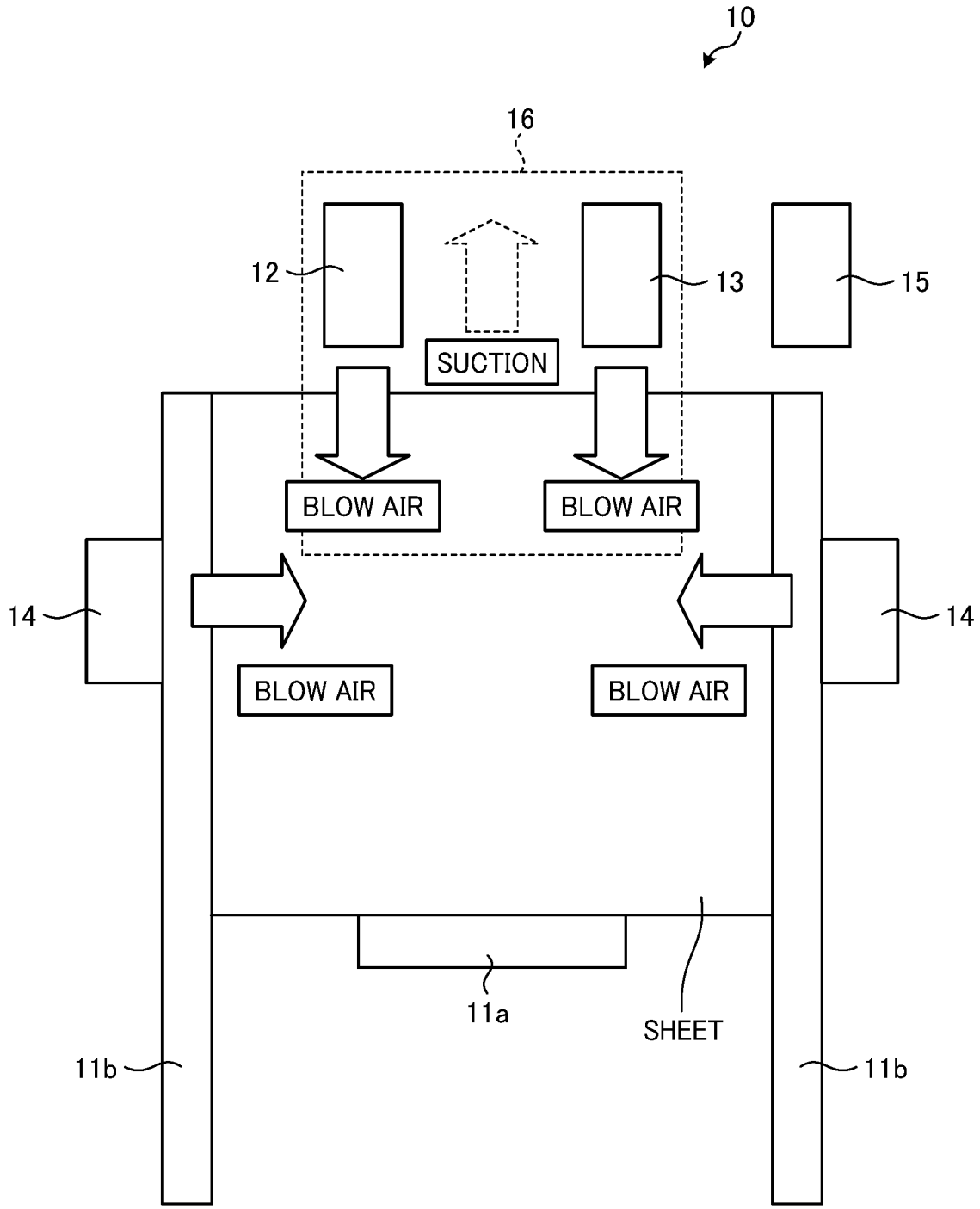
FIG. 4 is a schematic diagram of the configuration of the sheet feeder of FIG. 3.
Figure 5:
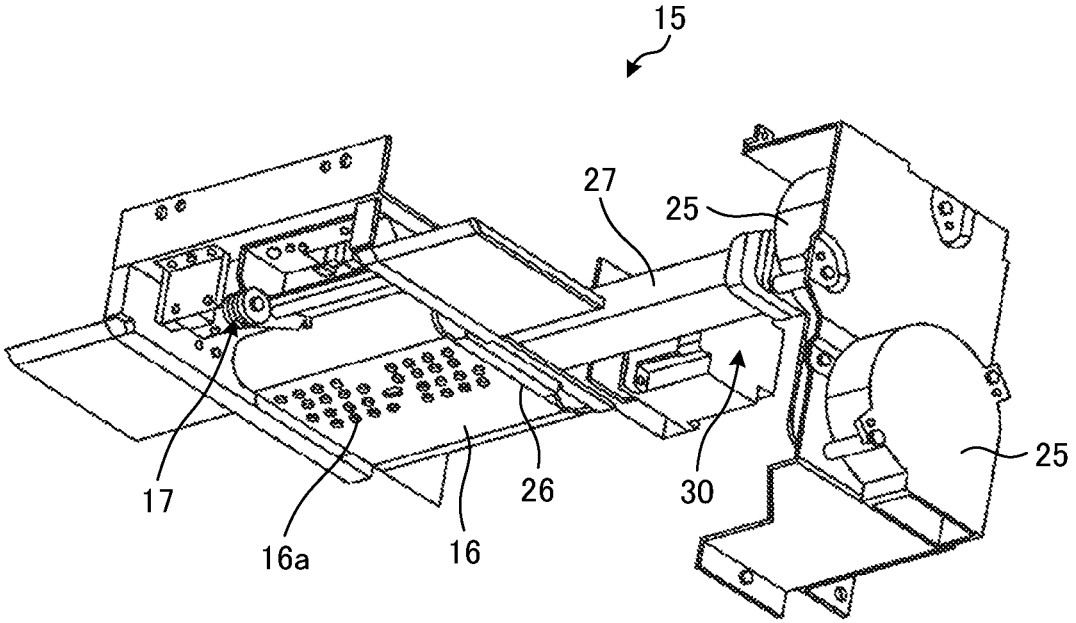
FIG. 5 is a perspective view of a part of the sheet feeder of FIG. 3.

FIG. 2 is a block diagram illustrating a hardware configuration of the image forming apparatus 1 according to an embodiment of the present disclosure. FIG. 3 is a perspective view of a configuration of the sheet feeder 10 according to an embodiment of the present disclosure. FIG. 4 is a schematic diagram of a configuration of the sheet feeder 10 according to an embodiment of the present disclosure. FIG. 5 is a perspective view of a part of the sheet feeder 10 according to an embodiment of the present disclosure.

As illustrated in FIG. 2, the image forming apparatus 1 includes a controller 100, a sheet feed controller 101, an upper limit position detector 17, a lower limit sensor 18, an intermediate remaining-sheet sensor 19, a sheet feeding tray elevator 20, a floating air blower fan 22, a separating air blower fan 23, a side air blower fan 24, a suction air blower fan 25, and a driving motor 30.

As illustrated in FIGS. 3 and 4, the sheet feeder 10 (serves as a sheet feeder) includes a sheet feeding tray 11, a floating air blower 12, a separating air blower 13, side air blowers 14, an air suction device 15, and a suction belt 16 serving as a sheet feeding member.

The controller 100 controls an image forming operation in the image forming device 2 based on an input signal from the operation input device or an input signal from a host computer connected to the outside of the image forming apparatus 1. The controller 100 outputs a sheet feed signal to the sheet feed controller 101.

The sheet feed controller 101 is configured to control various operations such as a separation suction operation and a sheet feeding operation in the sheet feeder 10 based on the sheet feed signal input from the controller 100.

The sheet feeding tray 11 is disposed at a lower portion of the sheet feeder 10, and a bundle of sheets is loaded on an upper portion of the sheet feeding tray 11. In other words, the sheet feeding tray 11 serves as a sheet loading tray on which sheets are loaded. The sheet feeding tray elevator 20 can move the sheet feeding tray 11 up and down in the vertical direction (up-down direction).

As illustrated in FIG. 2, the sheet feeding tray elevator 20 is connected to the sheet feed controller 101 and performs an elevating operation of the sheet feeding tray 11 based on an input signal from the sheet feed controller 101. Specifically, the sheet feed controller 101 controls the sheet feeding tray elevator 20 so that the sheet feeding tray 11 reaches the specified position based on detection signals from the upper limit position detector 17, the lower limit sensor 18, and the intermediate remaining-sheet sensor 19 connected to the sheet feed controller 101. The sheet feeding tray elevator 20 includes a driver such as an elevating motor.

The sheet feeding tray 11 includes an end fence 11*a* and side fences 11*b*. The end fence 11*a* is disposed at a rear side opposite to a leading side in a sheet feeding direction. The end fence 11*a* is an end fence that contacts the rear end of sheets to align the rear end of the sheets. The side fences 11*b* are a pair of side fences that are disposed on both ends of the sheet feeding tray 11 in a direction orthogonal to the sheet feeding direction and support a sheet when the sheet is fed.

The floating air blower 12 is disposed to face the leading end of sheets in the sheet feeding direction of the bundle of sheets. The floating air blower 12 includes a floating air blower fan 22 (see FIG. 2) as a floating-air blowing drive source. The floating air blower 12 blows air generated by the floating air blower fan 22 to the leading end of sheets in the sheet feeding direction of the bundle of sheets, to float upper sheets of the bundle of sheets including at least an uppermost sheet of the bundle of sheets. The floating air blower 12 includes multiple nozzles to blow air to the sheets along the leading end of sheets in the sheet feeding direction.

Similar to the floating air blower 12, the separating air blower 13 is disposed to face the leading end of sheets in the sheet feeding direction of the bundle of sheets. The separating air blower 13 includes the separating air blower fan 23 (see FIG. 2) as a separating air blowing drive source. Since the separating air blower 13 blows air generated by the separating air blower fan 23 to the leading end of multiple sheets, which are floated by the floating air blower 12, in the sheet feeding direction, the multiple floated sheets are separated one by one. In other words, the floating air blower 12 and the separating air blower 13 serve as an air blower that is disposed to face the leading end of sheets in the sheet feeding direction, blows air to the sheets to float the sheets and separate the sheets. The separating air blower 13 includes multiple nozzles to blow air to the sheets along the leading end of the sheets in the sheet feeding direction. The amount of air blown from the multiple nozzles to the sheets can be adjusted for each nozzle.

The side air blowers 14 are disposed to face both ends of the bundle of sheets, respectively, in the direction orthogonal to the sheet feeding direction. Each of the side air blowers 14 includes the side air blower fan 24 (see FIG. 2) as a side air blowing drive source. Since the side air blowers 14 blows air generated by the side air blower fan 24 to both lateral ends of the bundle of sheets. The multiple sheets floated from both lateral ends of the bundle of sheets can be separated one by one. In other words, the side air blowers 14 serves as side air blowers that are disposed to face both ends of the sheets in the direction orthogonal to the sheet feeding direction, blows air to the sheets to separate the sheets. The side air blower 14 includes multiple nozzles to blow air to the sheets along an end of the sheets in the direction orthogonal to the sheet feeding direction. The amount of air blown from the multiple nozzles to the sheets can be adjusted for each nozzle.

The air suction device 15 is disposed above the floating air blower 12 and the separating air blower 13. The air suction device 15 includes the suction air blower fan 25 (see FIG. 2) as an air suction drive source.

As illustrated in FIG. 5, the air suction device 15 includes a suction chamber 26 and a suction duct 27. The suction chamber 26 is disposed in a space surrounded by the upper and lower sides of the suction belt 16. The suction duct 27 connects the suction air blower fan and the suction chamber 26.

As illustrated in FIG. 3, the suction belt 16 is wound around a driven roller 28 and a driving roller 29. As the driving roller 29 is driven to rotate, the suction belt 16 is endlessly moved. As illustrated in FIG. 5, the driving roller 29 is connected to the driving motor 30. The driving motor 30 rotates the driving roller 29. Multiple holes 16*a* for sucking air are formed in the suction belt 16.

The air suction device 15 causes the suction air blower fan 25 to drive to suck air. Accordingly, the air suction device 15 creates a negative pressure inside the suction chamber 26.

As a result, the suction belt 16 sucks and holds an uppermost sheet separated from the bundle of sheets through the multiple holes 16*a*. Since the driving motor 30 drives at a predetermined timing set for each sheet based on a driving signal from the sheet feed controller 101, the suction belt 16 moves endlessly while the suction belt 16 sucks and holds the uppermost sheet. As a result, the uppermost sheet, which is sucked and held, is fed in the sheet feeding direction.

The upper limit position detector 17 detects that the sheets loaded on the sheet feeding tray 11 have moved to an upper limit position. Specifically, the upper limit position detector 17 includes a lever portion and a detection sensor. The lever portion contacts the upper surface of the sheets and is swingable in accordance with the height of the bundle of the sheets. The detection sensor is a sensor such as a transmissive photo interrupter. When the sheets loaded on the sheet feeding tray 11 reaches the upper limit position, the lever portion of the upper limit position detector 17 swings to shift the transmissive photo interrupter from a shielding state to a light receiving state. Accordingly, the upper limit position detector 17 detects that the sheets reach the upper limit position.

The lower limit sensor 18 detects that the sheet feeding tray 11 reaches a lower limit position located below the upper limit position. Specifically, the lower limit sensor 18 includes a lever portion and a detection sensor. The lever portion contacts the lower surface of the sheet feeding tray 11 and is swingable in accordance with the height of the sheet feeding tray 11. The detection sensor is a sensor such as a transmissive photo interrupter. When the sheet feeding tray 11 reaches the lower limit position, the lever portion of the lower limit sensor 18 swings to shift the transmissive photo interrupter from a shielding state to a light receiving state. Accordingly, the lower limit sensor 18 detects that the sheet feeding tray 11 reaches the lower limit position.

The intermediate remaining-sheet sensor 19 detects that the sheets loaded on the sheet feeding tray 11 have moved to an intermediate position. The intermediate position is a position below the upper limit position and above the lower limit position. Specifically, the intermediate remaining-sheet sensor 19 includes a lever portion and a detection sensor. The lever portion contacts the upper surface of the sheets and is swingable in accordance with the height of the bundle of the sheets. The detection sensor is a sensor such as a transmissive photo interrupter. When the intermediate remaining-sheet sensor 19 reaches the intermediate position, the lever portion of the intermediate remaining-sheet sensor 19 swings to shift the transmissive photo interrupter from a shielding state to a light receiving state. Accordingly, the intermediate remaining-sheet sensor 19 detects that the sheets reach the intermediate position.

The sheet feeder 10 includes the sheet feed controller 101. As illustrated in FIG. 2, the sheet feed controller 101 connects to the upper limit position detector 17, the lower limit sensor 18, the intermediate remaining-sheet sensor 19, the sheet feeding tray elevator 20, the driving motor 30, the floating air blower fan 22, the separating air blower fan 23, the side air blower fan 24, and the suction air blower fan 25.

The sheet feeding controller 101 stops driving of the sheet feeding tray elevator 20 based on the detection signal input from the upper limit position detector 17, and controls driving of each blower fan of the floating air blower fan 22, the separating air blower fan 23, the side air blower fan 24, and the suction air blower fan 25 at different timings.

As a result, air blowing by the floating air blower 12, air blowing by the separating air blower 13, air blowing by the side air blowers 14, and air suction by the air suction device are performed at different timings.

Figure 6:
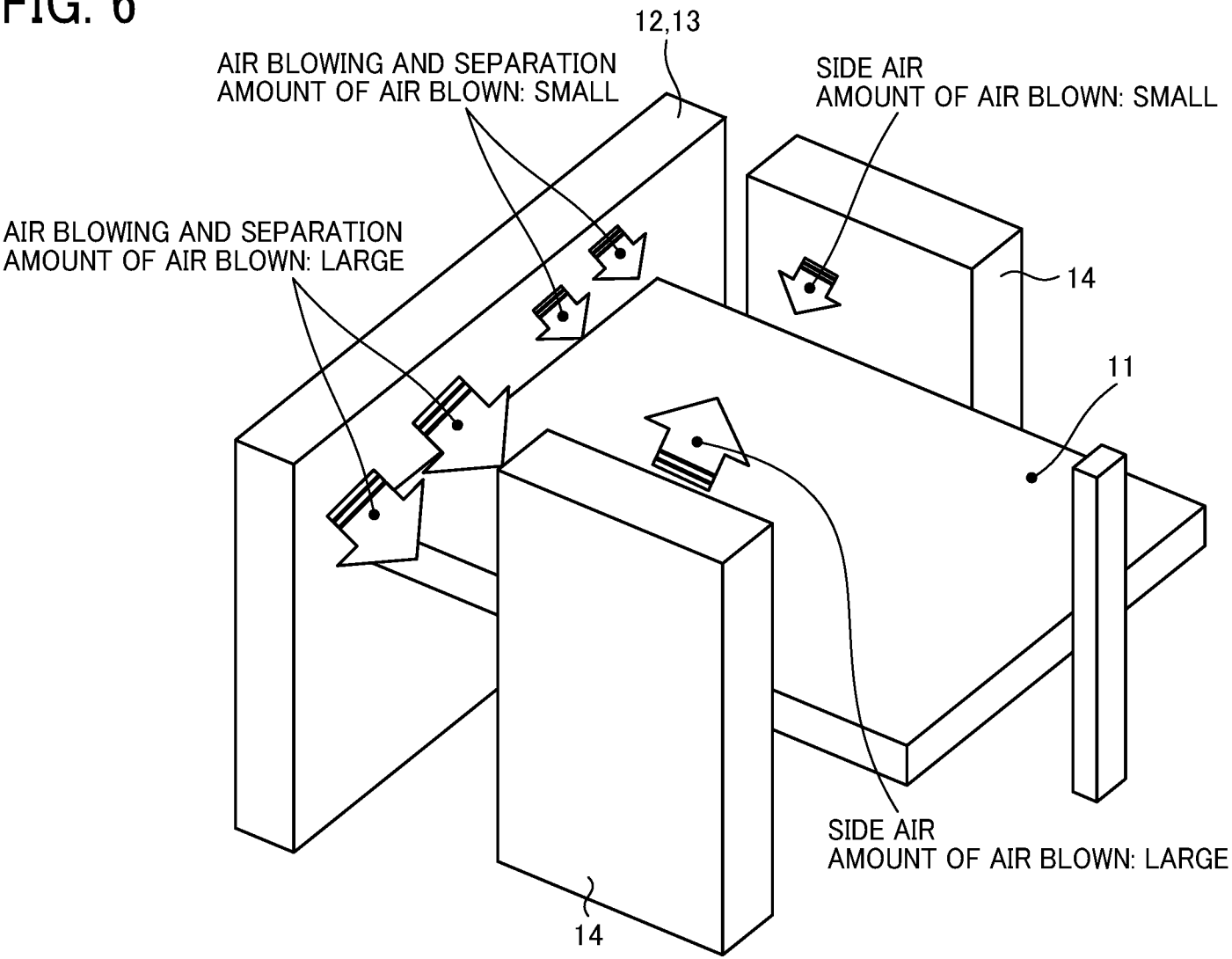
FIG. 6 is a diagram illustrating an outline of a mechanism of a sheet feeding tray according to an embodiment of the present disclosure.

FIG. 6 is a diagram illustrating an outline of a mechanism of the sheet feeding tray 11 according to an embodiment of the present disclosure; In the present embodiment, the sheet feed controller 101 (serving as a controller) controls the sheet feeding tray elevator 20 based on the detection signal from the upper limit position detector 17 to lift the sheet feeding tray 11 and move the sheets to the upper limit position, after a predetermined time has elapsed from the loading of the sheets onto the sheet feeding tray 11 with the sheet feeding tray 11 pulled out from a housing of the image forming apparatus 1.

When the sheets on the sheet feeding tray 11 are moved to the upper limit position, the sheet feed controller 101 causes the floating air blower 12, the separating air blower 13, and the side air blowers 14 to blow air to the sheets to perform sheet separation. As a result, the sheet feeder 10 can obviate a process of separating the sheets by a sheet separating device before the sheets are loaded on the sheet feeding tray 11 and reloading the sheets onto the sheet feeding tray 11 after completion of the sheet separation.

In the present embodiment, the sheet feed controller 101 causes the floating air blower 12, the separating air blower 13, and the side air blowers 14 to blow air in the direction in which the sheets are aligned by the sheet separation to move the sheets to the direction in which the sheets are aligned. Specifically, the sheet feed controller 101 decreases the amount of air blown to the sheets from the floating air blower 12, the separating air blower 13, and the side air blowers 14 toward the direction in which the sheets are aligned.

For example, as illustrated in FIG. 6, of the nozzles of the floating air blower 12, the separating air blower 13, and the side air blower 14, the sheet feed controller 101 sets the air amount of the side on which the sheets are to be aligned to be small and sets the air amount of the side opposite to the side on which the sheets are to be aligned to be large. As a result, the sheets are skewed by the air on the sheet feeding tray 11, and the sheets which are not aligned are aligned.

In the present embodiment, the sheet feed controller 101 can also adjust the amount of air blown to the sheets from the nozzles included in each of the floating air blower 12, the separating air blower 13, and the side air blower 14 according to the size or thickness of the sheet. For example, as the size or the thickness of the sheet increases, the sheet feed controller 101 increases the amount of air blown to the sheets from the nozzles of each of the floating air blower 12, the separating air blower 13, and the side air blower 14. As a result, since the air can be blown to the sheets with an air amount suitable for the size or thickness of the sheet, the accuracy of sheet separation can be enhanced.

After the sheet separation is completed, the sheet feed controller 101 controls the sheet feeding tray elevator 20 based on the detection signal from the intermediate remaining-sheet sensor 19 to lower the sheet feeding tray 11 to the intermediate position. Accordingly, in a case where sheets are loaded on the sheet feeding tray 11 in multiple times while the sheet separation is performed in the sheet feeding tray 11, the sheet feeding tray 11 can be lowered to an optimum position to add sheets after the sheet separation is performed for the sheets previously loaded on the sheet feeding tray 11. As a result, since the lowering time of the sheet feeding tray 11 can be shorten while the sheets are loaded, the sheet stacking operation can be performed in a bare minimum of lifting time.

Figure 7:
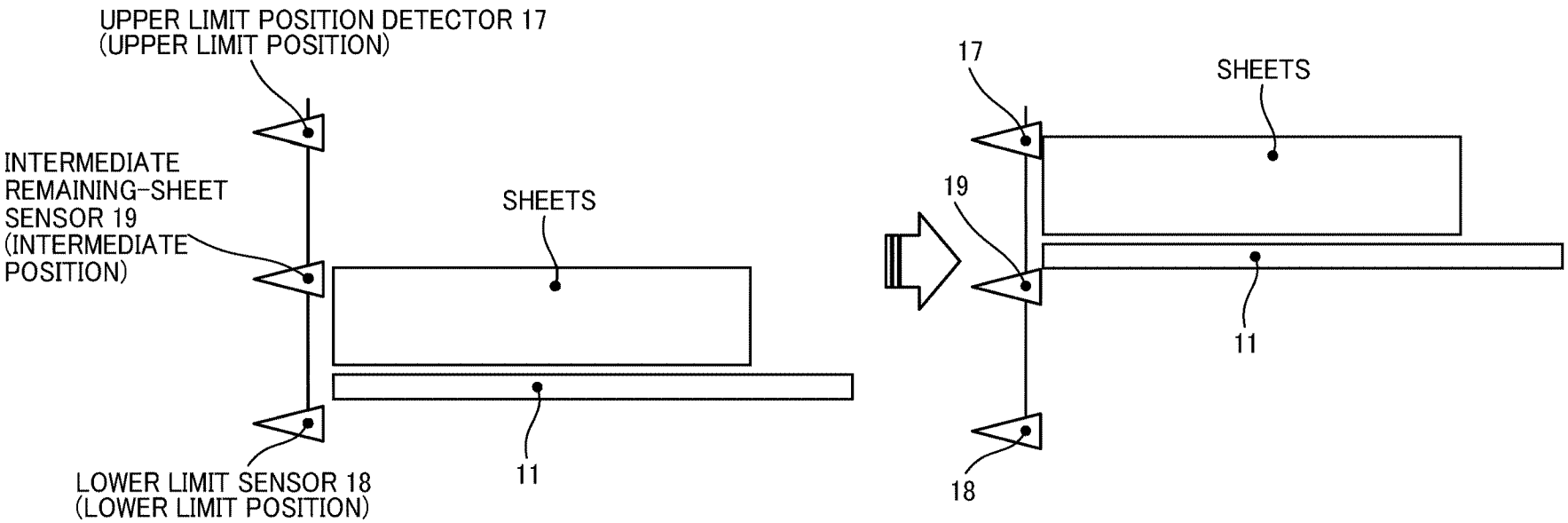
FIG. 7 is a diagram illustrating an elevating operation of a sheet feeding tray in a known sheet feeder when sheets are loaded to the known sheet feeder.
Figure 8:
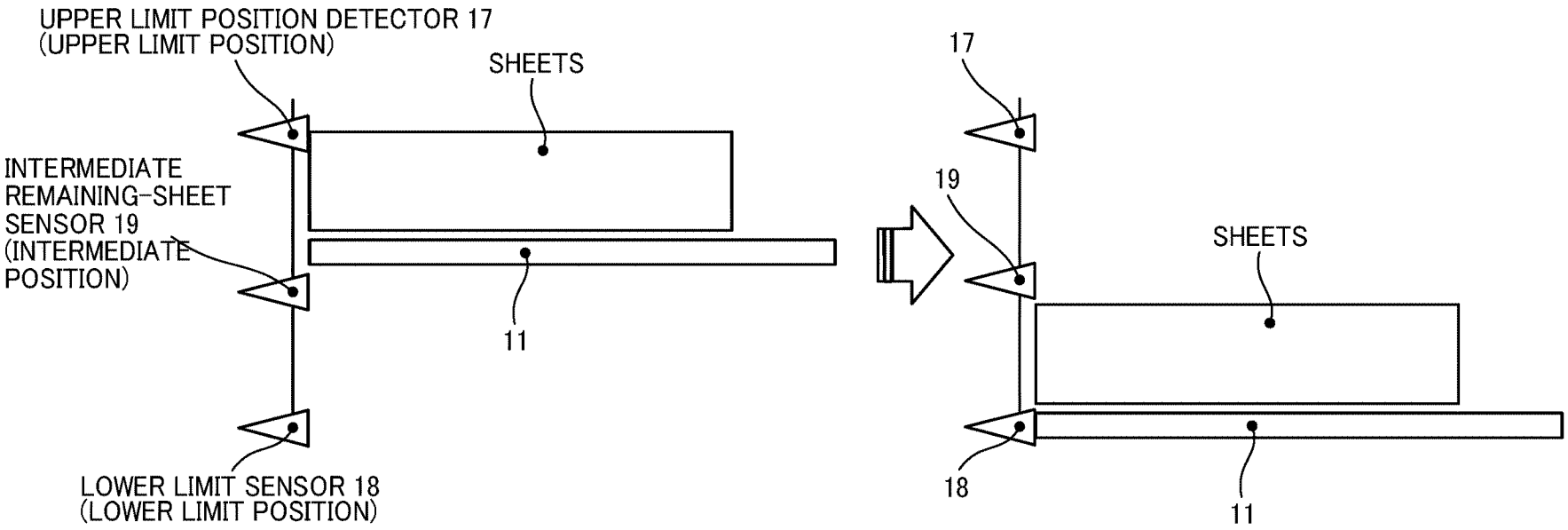
FIG. 8 is a diagram illustrating an elevating operation of the sheet feeding tray when the sheets are loaded to the sheet feeder according to an embodiment of the present disclosure.

FIG. 7 is a diagram illustrating an elevating operation of a sheet feeding tray in a comparative sheet feeder when sheets are loaded to the comparative sheet feeder. FIG. 8 is a diagram illustrating the elevating operation of the sheet feeding tray 11 when the sheets are loaded to the sheet feeder 10 according to an embodiment of the present disclosure. In the comparative sheet feeder, when the sheet feeding tray 11 is stored in a housing of the image forming apparatus 1 after the sheet feeding tray 11 is pulled out from the housing of the image forming apparatus 1 and the sheets are loaded onto the sheet feeding tray 11, the sheet feeding tray 11 is lifted to the upper limit position. Then, the comparative sheet feeder starts feeding sheets when the sheet feeding tray 11 is lifted to the upper limit position.

On the other hand, in the present embodiment, the sheet feed controller 101 controls the sheet feeding tray elevator 20 based on the detection signal from the intermediate remaining-sheet sensor 19 to lower the sheet feeding tray 11 to the intermediate position after the sheet separation is completed. Specifically, as illustrated in FIG. 8, when the intermediate remaining-sheet sensor 19 detects that the sheets loaded on the sheet feeding tray 11 have moved to the intermediate position before the lower limit sensor 18 detects that the sheet feeding tray 11 has reached the lower limit position after completion of the sheet separation, the sheet feed controller 101 causes the sheet feeding tray 11 to move to the intermediate position.

In other words, the sheet feed controller 101 switches whether to lower the sheet feeding tray 11 to the intermediate position or lower the sheet feeding tray 11 to the lower limit position in accordance with the loading amount (remaining amount) of sheets on the sheet feeding tray 11. Accordingly, in a case where sheets are loaded on the sheet feeding tray 11 in multiple times while the sheet separation is performed in the sheet feeding tray 11, the sheet feeding tray 11 can be lowered to an optimum position to add sheets after the sheet separation is performed for the sheets previously loaded on the sheet feeding tray 11. As a result, since the lowering time of the sheet feeding tray 11 can be shorten while the sheets are loaded, the sheet stacking operation can be performed in a bare minimum of lifting time.

Figures 9, 9A:
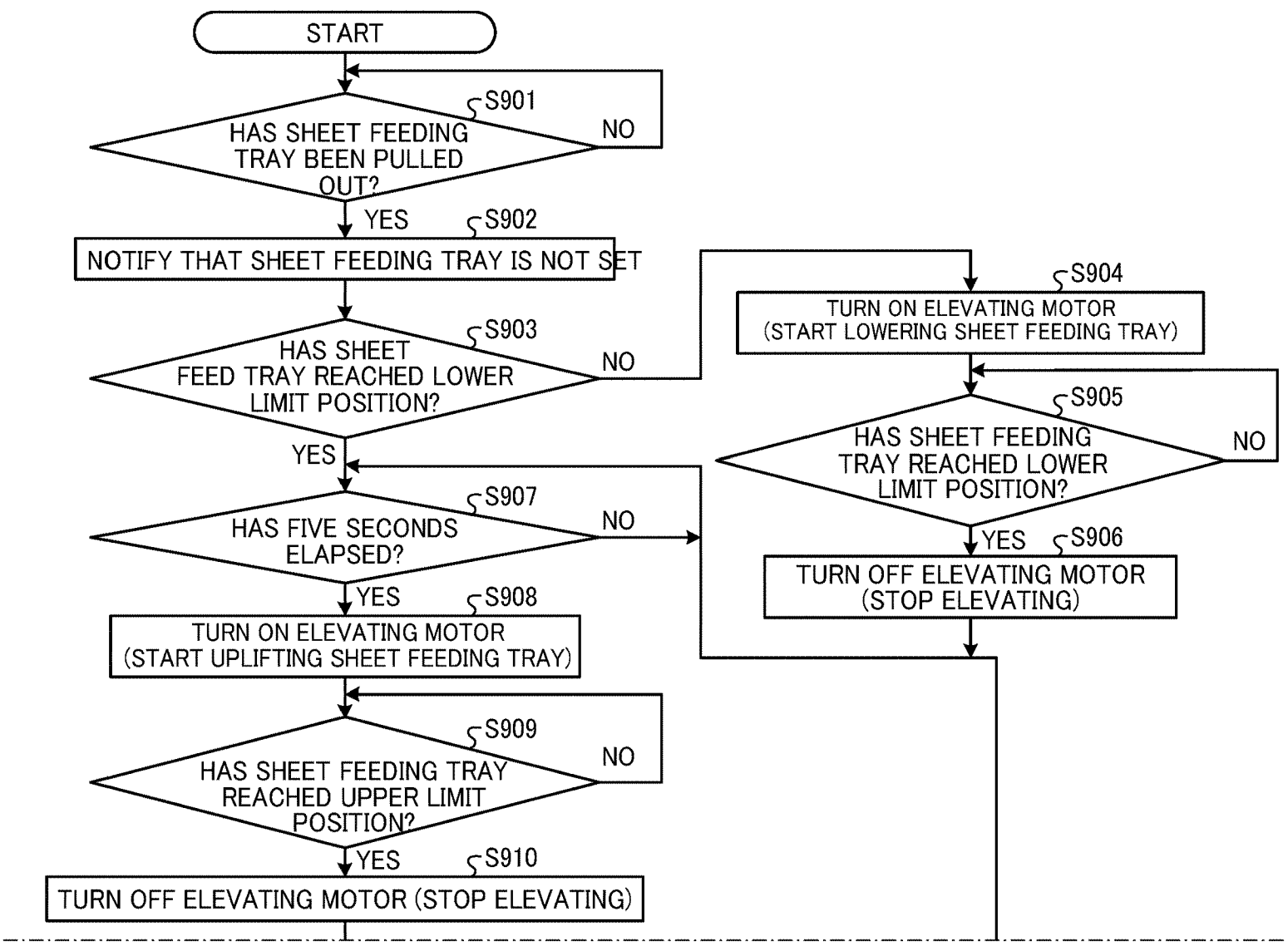
FIGS. 9A and 9B are flowcharts of sheet separation in the sheet feeder according to an embodiment of the present disclosure.
Figure 9B:
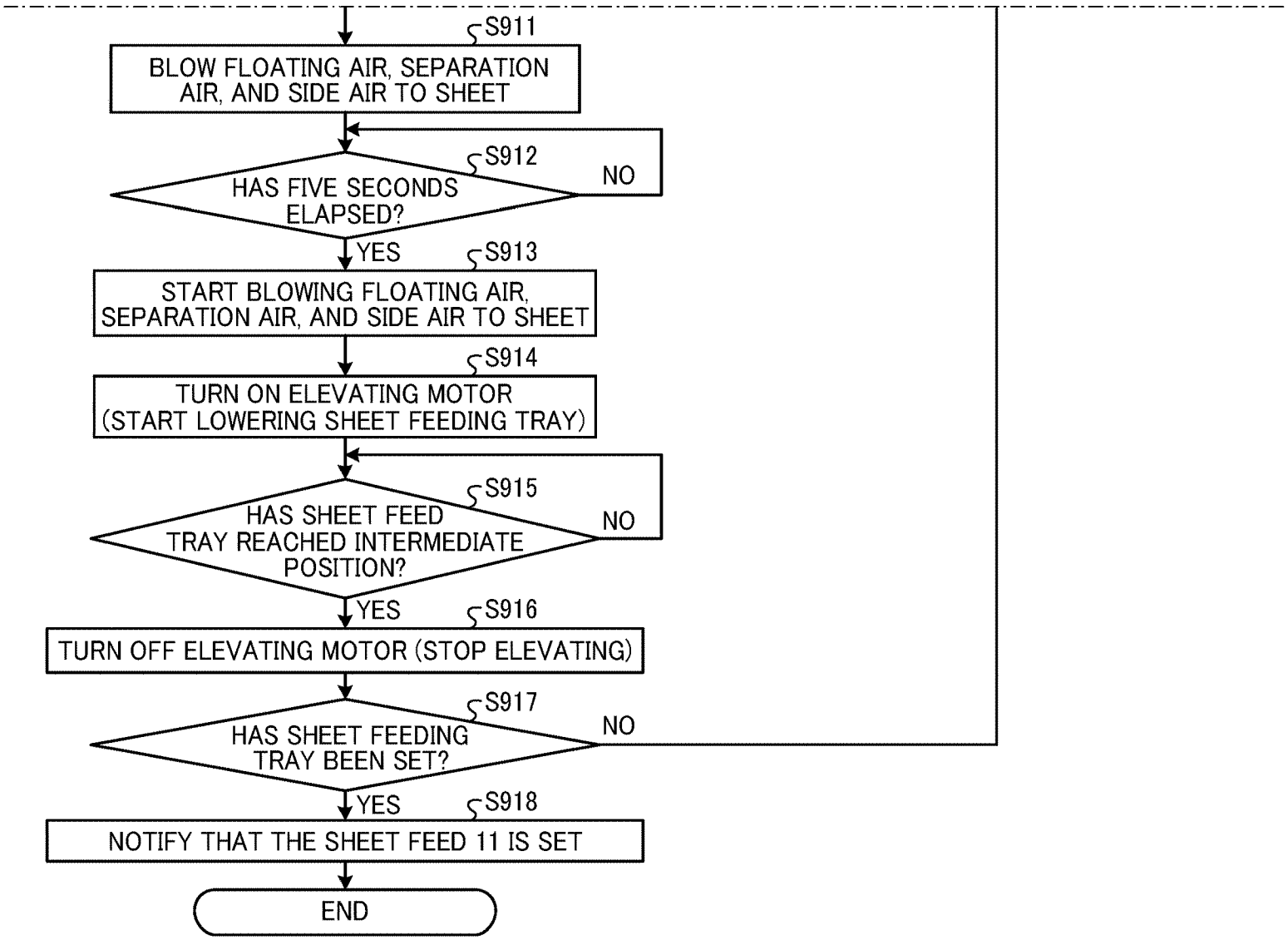

FIGS. 9A and 9B are flowcharts of the sheet separation in the sheet feeder 10 according to an embodiment of the present disclosure. First, the sheet feed controller 101 determines whether the sheet feeding tray 11 pulled out (step S901). When the sheet feeding tray 11 is pulled out (YES in step S901), the sheet feed controller 101 notifies a user that the sheet feeding tray 11 is not attached (step S902).

Next, the sheet feed controller 101 determines whether the sheet feeding tray 11 has reached the lower limit position based on the detection signal from the lower limit sensor 18 (step S903). When the sheet feeding tray 11 has reached the lower limit position (YES in step S903), sheets can be loaded on the sheet feeding tray 11. Accordingly, the sheet feed controller 101 proceeds to step 5907 without lowering the sheet feeding tray 11. On the other hand, when the sheet feeding tray 11 has not reached the lower limit position (NO in step S903), the sheets of a previous job may remain on the sheet feeding tray 11. In this case, since the sheet feeding tray 11 is to be lowered to the lower limit position such that the sheets can be loaded the sheet feeding tray 11, the sheet feed controller 101 drives the sheet feeding tray elevator 20 to lower the sheet feeding tray 11. In other words, the sheet feed controller 101 turns on the elevating motor to lower the sheet feeding tray 11 (step S904).

Next, the sheet feed controller 101 determines whether the sheet feeding tray 11 has reached the lower limit position based on the detection signal from the lower limit sensor 18 (step S905). When the sheet feeding tray 11 has reached the lower limit position (YES in step S905), the sheet feed controller 101 controls the sheet feeding tray elevator 20 to stop the lowering of the sheet feeding tray 11. In other words, the sheet feed controller 101 causes the sheet feeding tray elevator 20 to turn off the elevating motor to stop the lowering of the sheet feeding tray 11 (step S906) and proceeds to step S907.

Next, the sheet feed controller 101 waits for sheets to be loaded on the sheet feeding tray 11 by the user and stands by for a predetermined time (for example, five seconds) (step S907). After the predetermined time has elapsed (YES in step S907), the sheet feed controller 101 controls the sheet feeding tray elevator 20 to start lifting the sheet feeding tray 11. In other words, the sheet feed controller 101 causes the sheet feeding tray elevator 20 to turn on the elevating motor to start lifting the sheet feeding tray 11 (step S908). Then, the sheet feed controller 101 determines whether the upper limit position detector 17 detects that the sheets loaded on the sheet feeding tray 11 have moved to the upper limit position (step S909).

When the sheet feed controller 101 detects that the sheets loaded on the sheet feeding tray 11 have moved to the upper limit position (YES in step S909), the sheet feed controller 101 controls the sheet feeding tray elevator 20 to stop lifting the sheet feeding tray 11. In other words, the sheet feed controller 101 causes the sheet feeding tray elevator 20 to turn off the elevating motor to stop lifting the sheet feeding tray 11 (step S910). Next, the sheet feed controller 101 blows air to the sheets from the floating air blower 12, the separating air blower 13, and the side air blower 14 to perform the sheet separation (step S911). After the sheet separation is performed for a predetermined time (for example, 5s) (YES in step S912), the sheet feed controller 101 stops the blowing of air to the sheets from the floating air blower 12, the separating air blower 13, and the side air blower 14 (step S913).

Next, the sheet feed controller 101 controls the sheet feeding tray elevator 20 to turn on the elevating motor to lower the sheet feeding tray 11 (step S914). Then, the sheet feed controller 101 determines whether the intermediate remaining-sheet sensor 19 detects that the sheets loaded on the sheet feeding tray 11 have moved to the intermediate position (step S915). When the sheet feed controller 101 detects that the sheets loaded on the sheet feeding tray 11 have moved to the intermediate position (YES in step S915), the sheet feed controller 101 controls the sheet feeding tray elevator 20 to turn off the elevating motor to stop the lowering of the sheet feeding tray 11 (step S916).

Next, the sheet feed controller 101 determines whether the sheet feeding tray 11 is attached in the housing of the image forming apparatus 1 (step S917). When the sheet feeding tray 11 is not attached in the housing of the image forming apparatus 1 (NO in step S917), sheets may be further loaded onto the sheet feeding tray 11, and thus the sheet feed controller 101 returns to step 5907 and waits for the predetermined time to elapse. On the other hand, when the sheet feeding tray 11 is attached in the housing of the image forming apparatus 1 (YES in step S917), the sheet feed controller 101 notifies the user that the sheet feeding tray 11 is set (step 5918) and ends the process of the sheet separation.

As described above, according to the image forming apparatus 1 of the present embodiment, in a case where sheets are loaded on the sheet feeding tray 11 in multiple times while the sheet separation is performed in the sheet feeding tray 11, the sheet feeding tray 11 can be lowered to an optimum position to add sheets after the sheet separation is performed for the sheets previously loaded on the sheet feeding tray 11. As a result, since the lowering time of the sheet feeding tray 11 can be shorten while the sheets are loaded, the sheet stacking operation can be performed in a bare minimum of lifting time.

Note that programs executed by the image forming apparatus 1 according to the embodiments of the present disclosure may be pre-installed and provided in, for example, a read only memory (ROM). The program executed by the image forming apparatus 1 according to the present embodiment may be stored in a computer-readable storage medium, such as a compact disc read-only memory (CD-ROM), a flexible disk (FD), a compact disc recordable (CD-R), and a digital versatile disk (DVD), in an installable or executable file format, to be provided.

Alternatively, the program executed by the image forming apparatus 1 according to the present embodiment may be stored in a computer connected to a network such as the Internet and downloaded via the network, thus being providable. The program executed by the image forming apparatus 1 according to the present embodiment may be provided or distributed via a network such as the Internet.

The program executed by the image forming apparatus 1 according to the embodiments of the present disclosure has a module configuration including the above-described components (the sheet feed controller 101). In terms of actual hardware, a processor such as a central processing unit (CPU), reads the program from the ROM described above and executes the program, and thus the components are loaded onto a main storage device and the sheet feed controller 101 is generated on the main storage device.

Note that in the present embodiment as described above, the image forming apparatus 1 according to the present disclosure is applied to a multifunction printer or multifunction peripheral (MFP) that has at least two of a photocopying function, a printing function, a scanning function, and a facsimile (FAX) function. However, no limitation is intended thereby, and the image forming apparatus according to the present disclosure may be applied to any image forming apparatus such as a copier, a printer, a scanner, and a facsimile.

Aspects of the present disclosure are, for example, as follows.

Aspect 1

A sheet feeder includes a sheet loading tray, an air blower, a side air blower, and a controller. The sheet loading tray loads sheets. The air blower is disposed to face a leading end of the sheets in a feeding direction of the sheets loaded on the sheet loading tray. The air blower blows air to the sheets to float and separate the sheets. The side air blower is disposed to face an end of the sheets in a direction orthogonal to the feeding direction of the sheets. The side air blower blows air to the sheets to separate the sheets. The controller causes the sheet loading tray to rise to move the sheets to an upper limit position, after a predetermined time has elapsed since the sheets are loaded on the sheet loading tray pulled out from a housing of the image forming apparatus. The controller causes the air blower and the side air blower to blow air to the sheets to perform sheet separation when the sheets on the sheet loading tray are moved to the upper limit position. The controller causes the sheet loading tray to lower to a position at which an intermediate remaining-sheet sensor is disposed between the upper limit position and a lower limit position of the sheet loading tray, after the sheet separation ends.

Aspect 2

In the sheet feeder described in Aspect 1, the air blower includes multiple nozzles to blow air to the sheets along the leading end of the sheets in the feeding direction of the sheets. The side air blower includes multiple nozzles to blow air to the sheets along the end of the sheets in the direction orthogonal to the feeding direction of the sheets. The controller blows air in a direction in which the sheets are aligned by the sheet separation to move the sheets to the direction in which the sheets are aligned.

Aspect 3

In the sheet feeder described in Aspect 2, the amount of air blown from the multiple nozzles to the sheets can be adjusted for each nozzle. The controller adjusts the amount of air blown to the sheets from the multiple nozzles according to the size or thickness of the sheets.

Aspect 4

In the sheet feeder described in any one of Aspects 1 to 3, the controller switches, in accordance with the remaining amount of the sheets on the sheet loading tray, whether to lower the sheet loading tray to the lower limit position or the position at which the intermediate remaining-sheet sensor is disposed after the sheet separation ends.

Aspect 5

An image forming apparatus includes the sheet feeder according to any one of Aspects 1 to 4.

Aspect 6

A sheet feeding method is performed by a sheet feeder. The sheet feeding method includes: lifting a sheet loading tray, which loads sheets, to move the sheets to an upper limit position, after a predetermined time has elapsed since the sheets are loaded on the sheet loading tray pulled out from a housing of an image forming apparatus; blowing air by an air blower, which is disposed to face a leading end of the sheets in a feeding direction of the sheets loaded on the sheet loading tray and blow air to the sheets to float and separate the sheets, and a side air blower, which is disposed to face an end of the sheets in a direction orthogonal to the feeding direction of the sheets and blow air to the sheets to separate the sheets, to the sheets to perform sheet separation when the sheets on the sheet loading tray are moved to the upper limit position; and lowering the sheet loading tray to a position at which an intermediate remaining-sheet sensor is disposed between the upper limit position and a lower limit position of the sheet loading tray, after the sheet separation ends.

Aspect 7

A program is performed by a computer. The program causes the computer to execute a process. The process includes: lifting a sheet loading tray, which loads sheets, to move the sheets to an upper limit position, after a predetermined time has elapsed since the sheets are loaded on the sheet loading tray pulled out from a housing of an image forming apparatus; blowing air by an air blower, which is disposed to face a leading end of the sheets in a feeding direction of the sheets loaded on the sheet loading tray and blow air to the sheets to float and separate the sheets, and a side air blower, which is disposed to face an end of the sheets in a direction orthogonal to the feeding direction of the sheets and blow air to the sheets to separate the sheets, to the sheets to perform sheet separation when the sheets on the sheet loading tray are moved to the upper limit position; and lowering the sheet loading tray to a position at which an intermediate remaining-sheet sensor is disposed between the upper limit position and a lower limit position of the sheet loading tray, after the sheet separation is completed.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The invention claimed is:

1. A sheet feeder comprising:

a sheet loading tray to load sheets;

an air blower disposed to face a leading end of the sheets loaded on the sheet loading tray in a feeding direction of the sheets, the air blower to blow air to the sheets to float and separate the sheets;

a side air blower disposed to face an end of the sheets in a direction orthogonal to the feeding direction of the sheets, the side air blower to blow air to the sheets to separate the sheets; and processing circuitry configured to:

control a tray elevator to rise the sheet loading tray to move the sheets to an upper limit position, after a predetermined time has elapsed from a time when the sheets are loaded on the sheet loading tray being pulled out from a housing of an image forming apparatus;

cause the air blower and the side air blower to blow air to the sheets to perform sheet separation when the sheets on the sheet loading tray are moved to the upper limit position; and control the tray elevator to lower the sheet loading tray to a position at which an intermediate remaining-sheet sensor is disposed between the upper limit position and a lower limit position of the sheet loading tray, after the sheet separation ends.

2. The sheet feeder according to claim 1, wherein the air blower includes a plurality of nozzles to blow air to the sheets along the leading end of the sheets in the feeding direction of the sheets, wherein the side air blower includes a plurality of nozzles to blow air to the sheets along the end of the sheets in the direction orthogonal to the feeding direction of the sheets, and wherein the processing circuitry is configured to control the air blower and the side air blower to blow air in a direction in which the sheets are aligned by the sheet separation to move the sheets to the direction in which the sheets are aligned.

3. The sheet feeder according to claim 2, wherein the processing circuitry is configured to adjust an amount of air blown to the sheets from each one of the plurality of nozzles according to a size or thickness of the sheets.

4. The sheet feeder according to claim 1, wherein the processing circuitry is configured to, in accordance with a remaining amount of the sheets on the sheet loading tray, change the lowered position of the sheet loading tray after the sheet separation ends, between the lower limit position and the position at which the intermediate remaining-sheet sensor is disposed.

5. An image forming apparatus comprising:

the sheet feeder according to claim 1; and an image forming device to form an image on at least one of the sheets fed by the sheet feeder.

6. A sheet feeding method executed by a sheet feeder, the method comprising:

lifting a sheet loading tray, which loads sheets, to move the sheets to an upper limit position, after a predetermined time has elapsed from a time when the sheets are loaded on the sheet loading tray being pulled out from a housing of an image forming apparatus;

blowing air by an air blower and a side air blower, to perform sheet separation when the sheets on the sheet tray are moved to the upper limit position, the air blower being disposed to face a leading end of the sheets in a feeding direction of the sheets loaded on the sheet loading tray and to blow air to the sheets to float and separate the sheets, and the side air blower being disposed to face an end of the sheets in a direction orthogonal to the feeding direction of the sheets and to blow air to the sheets to separate the sheets; and lowering the sheet loading tray to a position at which an intermediate remaining-sheet sensor is disposed between the upper limit position and a lower limit position of the sheet loading tray, after the sheet separation ends.

7. A non-transitory, computer-readable storage medium storing computer-readable program code that causes a computer to perform:

controlling a tray elevator to lift a sheet loading tray, which loads sheets, to move the sheets to an upper limit position, after a predetermined time has elapsed from a time when the sheets are loaded on the sheet loading tray being pulled out from a housing of an image forming apparatus;

controlling an air blower and a side air blower to blow air to perform sheet separation when the sheets on the sheet tray are moved to the upper limit position, the air blower being disposed to face a leading end of the sheets in a feeding direction of the sheets loaded on the sheet loading tray and blow air to the sheets to float and separate the sheets, and the side air blower being disposed to face an end of the sheets in a direction orthogonal to the feeding direction of the sheets and blow air to the sheets to separate the sheets; and controlling the tray elevator to lower the sheet loading tray to a position at which an intermediate remaining-sheet sensor is disposed between the upper limit position and a lower limit position of the sheet loading tray, after the sheet separation ends.

* * * * *